United States Patent [19]

Shofner

[11] Patent Number: 5,071,130

[45] Date of Patent: Dec. 10, 1991

[54] DEVICE FOR PERFECTING A GOLFER'S SWING

[76] Inventor: Jack G. Shofner, 1208 Gristmill Cir., Knoxville, Tenn. 37909

[21] Appl. No.: 555,106

[22] Filed: Jul. 20, 1990

[51] Int. Cl.[5] ..... A63B 69/36

[52] U.S. Cl. ..... 273/187 A; 273/195 A

[58] Field of Search ..... 273/183 A, 187 R, 187 A, 273/187 B, 195 R, 195 A; 434/252; 283/117, 49

[56] References Cited

U.S. PATENT DOCUMENTS

| | | | |
|---|---|---|---|
| D. 225,242 | 11/1972 | Pruitt | D34/5 |
| D. 272,379 | 1/1984 | Cachola | D21/234 |
| D. 277,886 | 3/1985 | Murphy | D21/234 |
| 4,000,905 | 1/1977 | Shirhall | 273/187 A |
| 4,101,130 | 7/1978 | Richards | 273/187 A |
| 4,164,352 | 8/1979 | O'Brien | 273/187 A |
| 4,248,431 | 2/1981 | Burnes | 273/187 R |
| 4,434,983 | 3/1984 | Toggart | 273/187 R |
| 4,545,581 | 10/1985 | Williamson | 273/187 A |
| 4,805,913 | 2/1989 | Bott | 273/187 R |
| 4,915,387 | 4/1990 | Boxstrom | 273/187 A |

FOREIGN PATENT DOCUMENTS

| | | | |
|---|---|---|---|
| 8301202 | 4/1983 | World Int. Prop. O. | 273/183 A |

*Primary Examiner*—George J. Marlo
*Attorney, Agent, or Firm*—Pitts & Brittian

[57] ABSTRACT

A mat-type device for improving a golfer's swing that has a ball placement portion in the form of a grid, and a golfer's stance portion such that the golfer, through practice, forms a mental image of the ball placement with regard to the stance when using various golf clubs. In the preferred embodiment, the columns of spaces in the grid of the ball placement portion are marked with indicia at the end, with the rows of spaces marked with different indicia to further impress a mental image for the golfer. The device is made useful for either right- or left-handed golfers by having a center line, with the indicia for the columns of spaces within the grid being repeated on each side of the center line so as to make a mirror image. Additional lines can be imprinted in the stance portion of give guidance to the placement of the golfer's feet in relationship to the placement of the ball when using clubs of different shaft length. With this device a golfer can experiment with the placement of the ball with regard to foot stance (and club length) to achieve desired ball trajectory when hit. Repeated use of the device with the ball at the preferred position for a given club forms a mental image the golfer can recall to memory when actually on a golf course.

11 Claims, 2 Drawing Sheets

DEVICE FOR PERFECTING A GOLFER'S SWING

This invention was described in Disclosure Document Ser. No. 244,821 filed in the U.S. Patent and Trademark Office on Feb. 6, 1990.

TECHNICAL FIELD

The present invention relates to apparatus for assisting a golfer in improving his or her game, and more particularly to a mat-type device having a foot-placement portion and a ball-placement portion whereby a golfer can experiment as to the best placement of the ball to achieve optimum results when hitting the ball with various clubs with a given stance so as to optimize a "natural swing" of the golfer.

BACKGROUND ART

Each golfer, and particularly an amateur golfer, develops a swing pattern during the initial years of golfing. However, this swing pattern does not always result in a well hit ball. The principle variable is the position of the golfer with reference to the position of the ball. Another variable, of course, is the length of a specific club that is being used: the different woods, irons, etc.

There are numerous teaching devices that have been proposed to "mold" the golfer into a particular stance, and for positioning a ball being addressed where it theoretically will travel in a correct direction when hit. Other teaching devices attempt to develop a "preferred" swing to accomplish better results when hitting the ball with the various types of clubs. Typical of these devices are those shown and described in U.S. utility patents: U.S. Pat. No. 4,000,905 issued to M. J. Shirhall on Jan. 4, 1977; U.S. Pat. No. 4,101,130 issued to E. Richards on July 18, 1978; U.S. Pat. No. 4,164,352 issued to J. P. O'Brien on Aug. 14, 1979; U.S. Pat. No. 4,248,431 issued to D. A. Burnes on Feb. 3, 1981; U.S. Pat. No. 4,434,983 issued to F. K. Taggart on Mar. 6, 1984; U.S. Pat. No. 4,545,581 issued to P. J. Williamson on Oct. 8, 1985; U.S. Pat. No. 4,805,913 issued to R. L. Bott on Feb. 21, 1989; and U.S. Pat. No. No. 4,915,387 issued to G. D. Baxstrom on Apr. 10, 1990. Other devices are shown in U.S. design patents: U.S. Pat. No. 225,242 issued to F. W. Pruitt on Nov. 28, 1972; U.S. Pat. No. 272,379 issued to R. H. Cachola on Jan. 24, 1984; and U.S. Pat. No. 77,886 issued to W. A. Murphy on Mar. 5, 1985. While these devices are such that a uniform swing pattern can be developed while actively using the device, they do not created a mental image that the golfer can use when actually playing a game of golf. Others attempt to change a golfer's natural swing so that when used extensively, an "optimum" swing is developed.

Accordingly, it is an object of the present device to provide means for a golfer to experiment as to the placement of a ball in relationship to a foot stance and a particular golf club that will develop a mental image during use thereof that will carry over into a golf game where the device is not in use.

It is another object of the present invention to provide a rectangularly-shaped mat, either as a portable unit or a permanent practice unit, that has imprinted on a first portion a grid upon which a golfer can place a ball, with a second portion of the mat for placement of the feet of a golfer.

Another object of the present invention is to provide a mat upon a portion of which is imprinted a grid upon which a golfer can place a ball, with the columns of spaces in the grid provided with indicia at the ends thereof, and rows of spaces in the grid provided with separate indica at their ends.

A further object of the present invention is to provide, in a preferred embodiment, a mat upon a portion of which is imprinted with a grid having a center line to divide the grid into right and left portions, with the columns of spaces of the right portion of the grid having numerical indicia at ends thereof that increase in size to the right of the center line, and the columns of spaces of the left portion of the grid having similar numerical indicia at ends thereof that increase to the left of the center line so that the right and left portions are mirror images.

Also, it is an object of the present invention to have a mat having a first portion upon which a golfer stands which includes markings to indicate possible different foot positions, together with a grid imprinted on a second portion of the mat to provide the golfer with a multiplicity of golf ball locations so as to develop consistent ball trajectory patterns.

These and other objects of the present invention will become apparent upon a consideration of the drawings referred to below and the complete description of the invention that follows.

DISCLOSURE OF THE INVENTION

In accordance with the present invention, a mat-type construction is provided that is useful to a golfer in developing a swing that will give rise to uniformity of ball trajectories for different stances and different golf clubs. The particular value achieved is that through the design of this construction a mental image is created for the golfer as to ball positioning relative to foot stance such that this image is useful when hitting a golf ball during an actual golf game when the mat is not used. Toward this end, the mat is generally rectangular with a line imprinted across the width such as to divide the mat into a foot placement portion and a ball placement portion. The ball placement portion has imprinted thereon a grid made up of columnar lines and row lines. In the preferred embodiment, the grid has a center line that divides the grid into a right portion and a left portion. Further, in this preferred embodiment each column of spaces to the left of the center line has an ever increasing numerical indicia starting at the center line, and each column of spaces to the right of the center line has a similarly increasing indicia beginning at the center line. Further, each of the rows of spaces is identified with separate indicia that are different (e.g., are letters instead of numerals) from those of the columnar lines. These indicia further help in the formation of the mental image for the golfer. If desired, the foot-placement portion of the mat can have lines imprinted thereon to indicate different locations for toe placement relative to the ball placement grid that would be useful for different golfers.

BEST MODE FOR CARRYING OUT THE INVENTION

Figure 1:
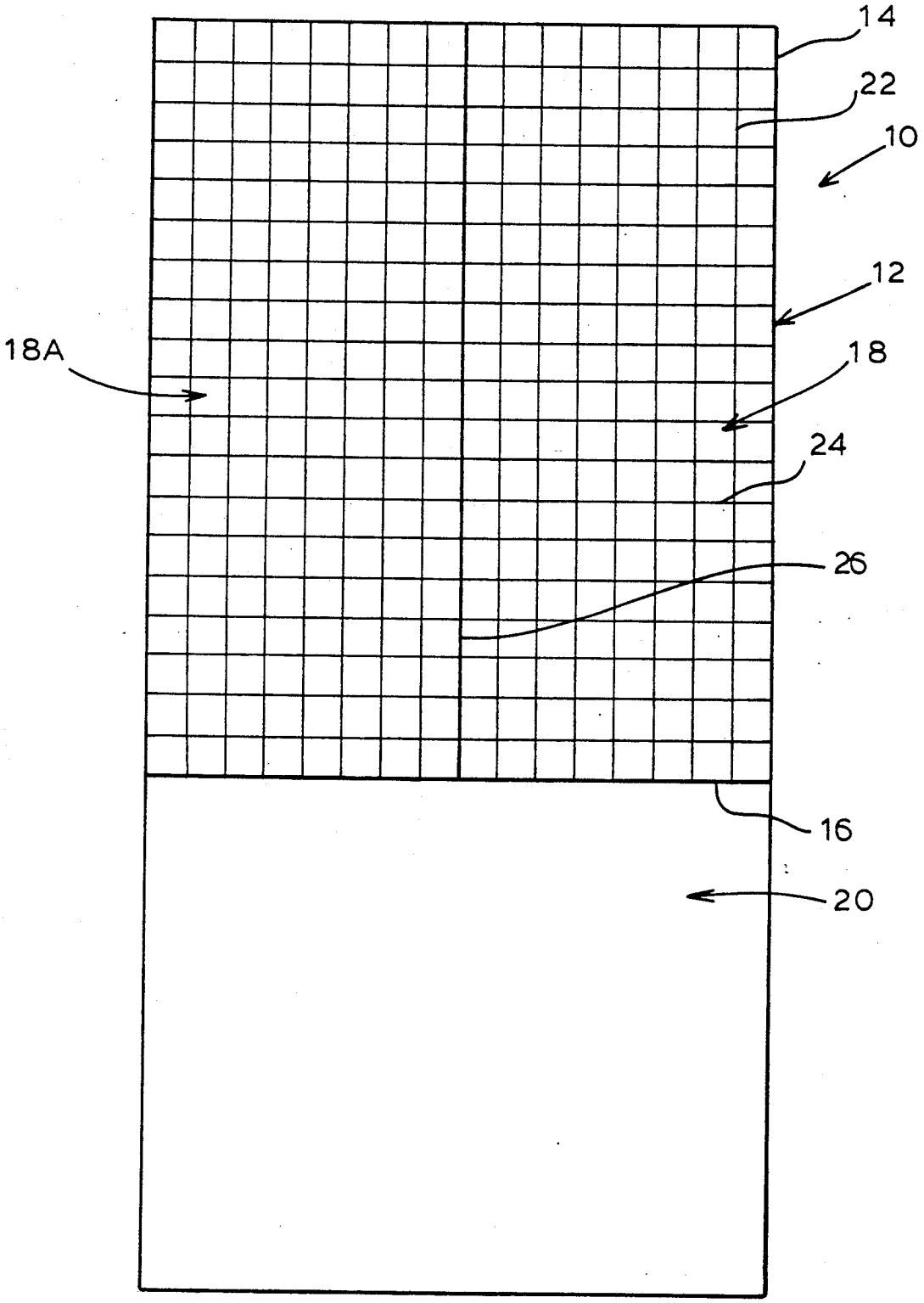
FIG. 1 is a plan view of one embodiment of the present invention indicating the location of the region for the placement of the golfer's feet and for the placement of a golf ball.

A simplified embodiment of the present invention is illustrated generally at 10 in FIG. 1. This device 10 can be a separate mat 12 having a perimeter line 14. It is typically fabricated from a carpeting such as, for example, "Action Turf", Series 200 as available from Controlled Products, Inc., 3620-A South Dog Gap Road, P.O. Box 1964, Dalton, Ga. 30722. Alternatively, the device can be imprinted upon a larger piece of covering as might be found at golf driving ranges, for example. In either case there is defined a "rectangularly-shaped base". The mat area is rectangular, with typical dimensions being fifty-four inches in length and thirty-six inches in width. A dividing line 16 extending between the side edges divides the mat area into a ball-positioning portion 18 and a foot-stance portion 20 for purposes discussed hereinafter. The ball-positioning portion 18 has imprinted thereon a grid made up of columnar lines 22 and row lines 24. Typically these grid lines 22, 24 form square spaces that are 1½ inch by 1½ inch. Of course, other spacings of grid lines can be used: the typical spacing has been found to be of a size that forms a good image and provides sufficient locations for the placement of a golf ball. In addition, a central columnar line 26 is provided that divides the ball-placement portion into left portion 18A in addition to the right portion 18. Among other reasons, this provides a symmetrical mat such that it can be used by either righthanded or lefthanded golfers. The perimeter line 14 and the two dividing lines 16, 26 can be made wider than the columnar and row lines so as to be more easily recognized by the golfer using the mat.

The device 10 is useful for developing a ball placement that will result in a given trajectory. This is accomplished through experimentation by the golfer. Using a particular stance and golf club, the golfer hits balls set at different locations on the grid of columnar and row lines. Some balls will tend to be pulled to the left; others to the right. This is continued until the golfer locates the position on the grid where a ball, when so placed, will have a desired trajectory. This will be repeated until the golfer forms a mental picture of this ideal relationship of the feet, ball placement and a head of a given club. This experimentation of ball placement is continued for each of the different clubs that will be used by the golfer until a mental image for each is created. Then, when the golfer is involved in a regular game of golf, these mental images will be used to orient the golfer with respect to the ball for the selected trajectory of the ball.

Figure 2:
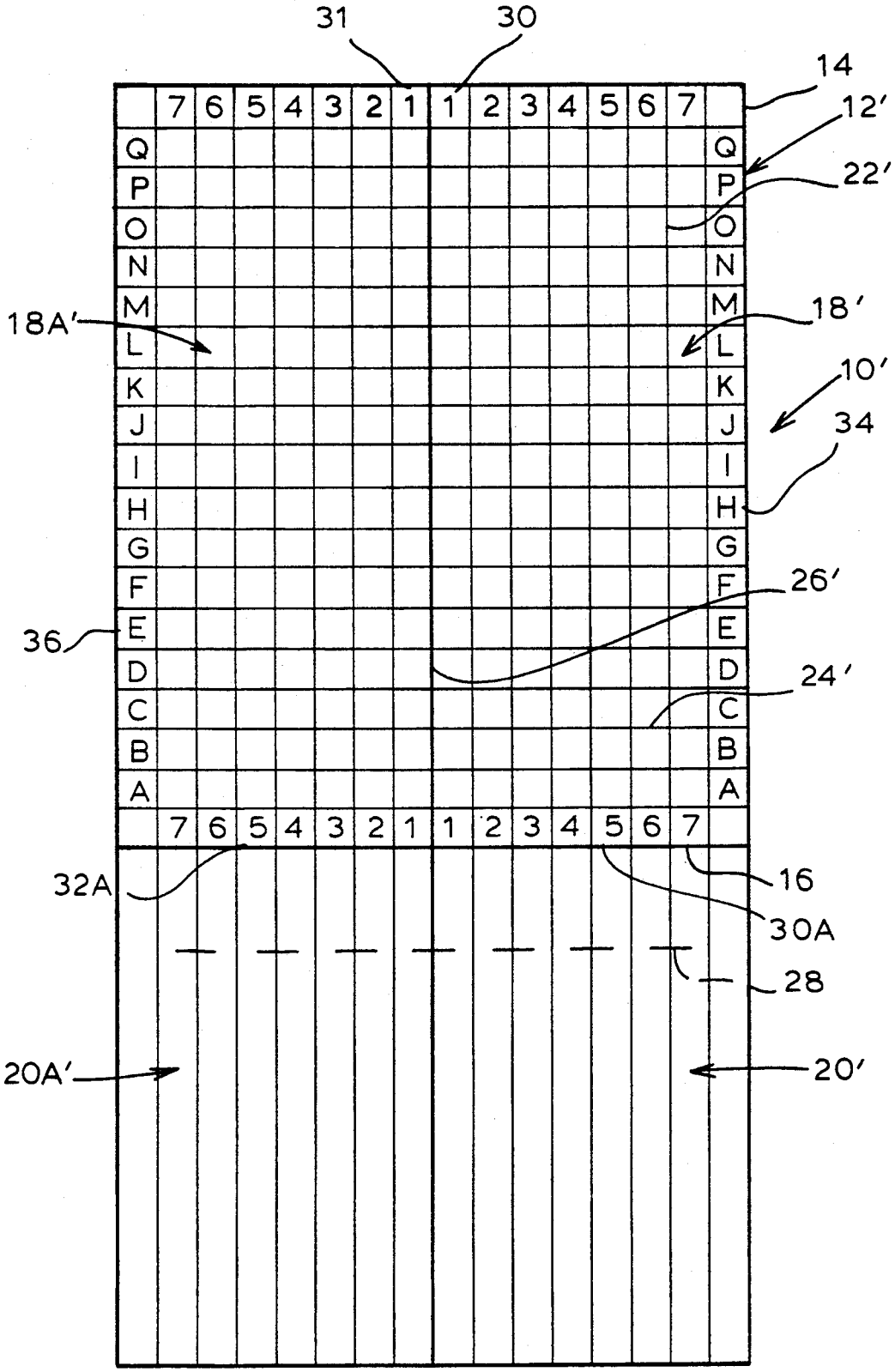
FIG. 2 is a plan view of another and preferred embodiment of the present invention.

Although the embodiment of FIG. 1 will help develop the needed mental images for a golfer, more precise mental images will be produced if the embodiment 10' of FIG. 2 is utilized. In this embodiment any element that is identical to a corresponding element of FIG. 1 carries the same element number. Elements that are similar, but modified, use the same element number but are primed. Thus, there is a perimeter line 14 and a transverse dividing line 16 to produce a ball placement grid 18', 18A' and the foot placement portion 20', 20A'. All of the columnar lines 22', including the dividing line 26' are continued into the foot-placement portions 20', 20A' so as to provide a user with specific stance lines. Further, if desired, one or more toe lines 28 are imprinted on the mat 12'.

Another feature of this preferred embodiment 10' is the use of indicia to identify the positions of ball placement upon the grid of portions 18', 18A'. For example, numerical indicia 30, 30A (1, 2, 3, etc.) are placed at the top and bottom of columnar spaces as shown, with the smallest number being assigned to the column adjacent the center dividing line 26'. Further numerical indicia, as at 32, 32A are a repeat of the numerical indicia (1, 2, 3, etc.) beginning to the left of center dividing line 26'. Alphabetical indicia (A, B, C, etc.) are arranged for each of the rows of spaces in the grid, as indicated at 34, 36, with the A indicia being closest to the transverse dividing line 16. Of course, it will be understood that the order of the indicia could be reversed, or other indicia utilized to identify the positions on the grid 18', 18A'.

The embodiment 10' of FIG. 2 is used in the same manner as embodiment 10 of FIG. 1. A golfer takes a given stance on the foot placement portions 20', 20A'. Then, using a selected golf club, the golfer positions the ball upon a selected position on the grid 18', 18A' and strikes the ball. If the ball trajectory is incorrect for the normal swing of the golfer, the golfer changes the position of the ball until the desired trajectory is correct. Repetition of driving the ball from this location, which results in a high degree of uniformity, causes a mental picture to be recorded by the golfer such that, when playing on a golf course, results in improved ball trajectory for the different clubs that are used.

I claim:

1. A device for perfecting a golfer's swing, which comprises:

a rectangularly-shaped base member of turf simulating material to support a golf ball, said base member defining opposite and parallel side edges, a front edge and a rear edge parallel to said front edge;

a transverse line indicia on said base member connecting said opposite side edges to define on said base member a ball placement portion and a foot placement portion, said transverse line indicia being parallel to said top and bottom edges;

a plurality of columnar and row line indicia on said base member within said ball placement portion to define a grid of columnar spaces and row spaces, said columnar line indicia being parallel with said side edges and said row line indicia being parallel with said top and bottom edges;

a vertical line indicia extending from said top edge to at least said transverse line indicia to divide said grid into equal right and left portions, said vertical line indicia being parallel to said side edges;

a first set of identifying indicia affixed to said base member at each row of said columnar spaces proximate said top edge and proximate said transverse line indicia, said first set of identifying indicia having a first portion on a right side of said vertical line indicia having a first portion on a right side of said vertical line indicia and a second portion on a left side of said vertical line indicia that is a mirror image of said first portion; and a second set of identifying indicia affixed to said base member at each row of said row spaces proximate each of said side edges, said second set of identifying indicia being a different type than said first set of identifying indicia.

2. The device of claim 1 wherein said spaces defines by said columnar and row indicia lines are squares.

3. The device of claim 1 wherein said first set of identifying indicia are consecutive numerical indicia and said second set of identifying indicia are sequential alphabetical indicia.

4. The device of claim 3 wherein said sequential alphabetical indicia consecutively progress from proximate said transverse line indicia toward said rear edge of said base member.

5. A device for perfecting a golfer's swing, which comprises:

a rectangularly-shaped base member of turf simulating material to support a golf ball, said base member defining opposite and parallel side edges, a front edge and a rear edge parallel to said front edge;

a transverse line indicia on said base member connecting said opposite side edges to define on said base member a ball placement portion and a foot placement portion, said transverse line indicia being parallel to said top and bottom edges;

a plurality of columnar and row line indicia on said base member within said ball placement portion to define a grid of columnar spaces and row spaces, said columnar line indicia being parallel with said side edges and said row line indicia being parallel with said top and bottom edges, said spaces defined by said columnar and row indicia lines being squares;

a vertical line indicia extending from said top edge to at least said transverse line indicia to divide said grid into two substantially equal portion, said vertical line indicia being parallel to said side edges;

a set of numerical indicia affixed to said base member at each row of said columnar spaces proximate said top edge and proximate said transverse line indicia, said set of numerical indicia being divided by said vertical line indicia into a first portion and a second portion, said second portion being a mirror image of said first portion; and a set of alphabetical indicia affixed to said base member at each of said row spaces proximate each of said side edges, said alphabetical indicia proximate one said side edge being a mirror image of alphabetical indicia proximate said opposite side edge.

6. The device of claim 5 wherein said columnar indicia lines and said vertical line indicia extend from said top edge of said base member to said bottom edge of said base member.

7. The device of claim 5 wherein said set of numerical identifying indicia are consecutive numerical indicia and said set of alphabetical identifying indicia are sequential alphabetical indicia, said first portion and said second portion of said set of numerical identifying indicia having a lowest value adjacent said vertical line indicia and increasing in value toward said side edges of said base member.

8. The device of claim 5 further comprising border line indicia affixed to said base member proximate said front, rear and side edges, and wherein said border line indicia, said transverse line indicia and said vertical line indicia are wider than said columnar and row line indicia so as to be more recognizable by a user of said device.

9. A device for perfecting a golfer's swing, which comprises:

a rectangularly-shaped base member of turf simulating material to support a golf ball, said base member defining opposite and parallel side edges, a front edge and a rear edge parallel to said front edge;

a transverse line indicia on said base member connecting said opposite side edges to define on said base member a ball placement portion and a foot placement portion, said transverse line indicia being parallel to said top and bottom edges;

a plurality of columnar and row line indicia on said base member within said ball placement portion to define a grid of columnar spaces and row spaces, said columnar line indicia being parallel with said side edges and said row line indicia being parallel with said top and bottom edges, said spaces defined by said columnar and row indicia lines being squares;

a vertical line indicia extending from said top edge to at least said transverse line indicia to divide said grid into two substantially equal portions, said vertical line indicia being parallel to said side edges;

a set of consecutive numerical indicia affixed to said base member at each row of said columnar spaces proximate said top edge and said transverse line indicia, said set of numerical indicia divided at said vertical line indicia wherein numerical indicia on a right side of said vertical line indicia are mirror images of numerical indicia on a left side of said vertical line indicia; and a set of sequential alphabetical indicia affixed to said base member at each row of said row spaces proximate each of said side edges, said sequential alphabetical indicia proximate one side edge being mirror images of said sequential alphabetical indicia proximate said opposite side edge.

10. The device of claim 9 wherein said columnar indicia lines extend from said top edge of said base member to said bottom edge of said base member.

11. The device of claim 10 further comprising a plurality of further transverse line indicia within said foot placement portion of said mat member parallel to said bottom edge to indicate toe positions within said foot placement portion.

* * * * *